US012137796B2

(12) United States Patent
Manninen

(10) Patent No.: US 12,137,796 B2
(45) Date of Patent: Nov. 12, 2024

(54) STRINGER FOR RETAINING EMPTY BEVERAGE CANS

(71) Applicant: John Manninen, Paradise, CA (US)

(72) Inventor: John Manninen, Paradise, CA (US)

( * ) Notice: Subject to any disclaimer, the term of this patent is extended or adjusted under 35 U.S.C. 154(b) by 0 days.

(21) Appl. No.: 17/932,404

(22) Filed: Sep. 15, 2022

(65) Prior Publication Data

US 2024/0090654 A1 Mar. 21, 2024

(51) Int. Cl.

| | |
|---|---|
| ***A45F 5/10*** | (2006.01) |
| ***A45F 5/00*** | (2006.01) |
| ***B65D 71/40*** | (2006.01) |
| ***B65D 73/00*** | (2006.01) |
| ***B65D 81/36*** | (2006.01) |

(52) U.S. Cl.

CPC ..... *A45F 5/1026* (2013.01); *B65D 71/40* (2013.01); *B65D 73/0064* (2013.01); *B65D 81/36* (2013.01); *A45F 2005/006* (2013.01); *A45F 2005/104* (2013.01); *A45F 2200/0583* (2013.01)

(58) Field of Classification Search

CPC .... B65D 81/36; B65D 73/0064; B65D 71/40; B65D 73/0071; B65D 71/504; B65D 71/50; B65D 71/00; A45F 5/1026; A45F 2200/0583; A45F 5/102; A45F 2005/006; A45F 2005/104

USPC ..... 206/223; 229/125.03, 248, 239; 294/149, 143, 158

See application file for complete search history.

(56) References Cited

U.S. PATENT DOCUMENTS

| | | | | | |
|---|---|---|---|---|---|
| 2,970,729 | A * | 2/1961 | Allen | A47J 47/16 | 24/30.5 R |
| 2,972,438 | A * | 2/1961 | Kimbrough | A01K 65/00 | 224/103 |
| 3,371,830 | A * | 3/1968 | Parkman | A01K 65/00 | 224/103 |
| 4,094,391 | A * | 6/1978 | Ratchford | A45C 13/26 | D3/315 |
| 4,712,671 | A | 12/1987 | Salacuse | | |
| 4,811,846 | A * | 3/1989 | Bottega | B65D 1/34 | 206/542 |
| 4,960,231 | A * | 10/1990 | Popovich | A01K 65/00 | 224/103 |

(Continued)

FOREIGN PATENT DOCUMENTS

| | | | | |
|---|---|---|---|---|
| DE | 7720209 U1 | 11/1978 | | |
| WO | WO-2014109735 A1 * | 7/2014 | ..... | A45F 5/1026 |

*Primary Examiner* — Rafael A Ortiz

(74) *Attorney, Agent, or Firm* — Maschoff Brennan

(57) ABSTRACT

A stringer for retaining empty beverage cans is disclosed. The stringer may include a catch at a first end of the stringer. The catch may be configured to be threaded through a hole in a tab of a beverage can. The stringer may also include a stopper that is configured to prevent the beverage cans from falling off of a second end of the stringer. An elongated neck may be positioned between the catch and the stopper that is configured to hold a plurality of beverage cans. The catch, the stopper, and the elongated neck may all be manufactured from a unitary piece of material or may be a combination of different materials. This material may be aluminum to allow the stringer to remain attached to cans during the recycling process or a ferromagnetic metal so that the stringer may be extracted magnetically in the recycling process.

20 Claims, 4 Drawing Sheets

(56) References Cited

U.S. PATENT DOCUMENTS

| | | | | | |
|---|---|---|---|---|---|
| 5,189,761 | A * | 3/1993 | Chisholm | B65D 63/18 | 24/17 AP |
| 5,234,245 | A * | 8/1993 | Peterson | B65D 63/1027 | 294/149 |
| 5,303,675 | A * | 4/1994 | Van Den Bergh | A01K 1/0114 | 119/168 |
| 5,482,195 | A * | 1/1996 | Hobbs | A01K 65/00 | 224/103 |
| 5,882,056 | A * | 3/1999 | Broadwell | A63B 71/00 | 294/158 |
| 6,513,657 | B2 * | 2/2003 | Sheehan, Jr. | B65D 75/66 | 53/413 |
| 6,976,719 | B2 * | 12/2005 | Agayof | B65D 63/1027 | 24/16 PB |
| 7,086,545 | B2 | 8/2006 | Mannion et al. | | |
| D619,887 | S * | 7/2010 | Colton | D8/396 | |
| D703,040 | S * | 4/2014 | White | D9/434 | |
| 9,403,630 | B2 * | 8/2016 | Bowman | B65D 63/1027 | |
| 10,709,230 | B1 * | 7/2020 | Aday | A45F 5/102 | |
| 2014/0366333 | A1 * | 12/2014 | Colton | E04C 5/167 | 24/20 R |
| 2018/0153285 | A1 * | 6/2018 | Tanaka | A45F 5/102 | |

* cited by examiner

STRINGER FOR RETAINING EMPTY BEVERAGE CANS

BACKGROUND

Beverage manufacturers often sell their products in aluminum cans. Boxes and other packaging materials make these canned beverages simple to buy and transport. However, there is no simple way to collect and transport empty beverage cans. The most basic way to collect and transport empty beverage cans is by manually carrying as many as possible. This, however, is inefficient and time consuming. Another option is to use the packaging unit in which the full beverages were sold to collect and carry empty cans. This, however, may result in contaminating cans that are still full and within the packaging and may require full beverages to be removed from the packaging, which defeats the purpose of having packaging unit that allows people to consume as few or as many beverages as they choose. Placing empty beverage cans in trash bags is another options, however, trash bags are inconvenient, cost much more, use more material, and visually obscure the contents of the bag, which could result in the beverage cans being discarded and not recycled.

The subject matter claimed in the present disclosure is not limited to embodiments that provide any of the advantages or solve any of the disadvantages described above.

SUMMARY

In one embodiment, a stringer for retaining empty beverage cans is provided. The stringer may include a catch at a first end of the stringer, the catch being configured to be threaded through a hole in a tab of a beverage can; a stopper configured to prevent the beverage cans from falling off of a second end of the stringer; and an elongated neck between the catch and the stopper, the elongated neck being configured to hold a plurality of beverage cans. The catch, the stopper, and the elongated neck may all be manufactured from a unitary piece of material.

In some embodiments, the material from which the stringer is manufactured may be cardboard, plastic, aluminum, or a ferromagnetic metal. The elongated neck may have a cross-sectional shape that is flat, round, or "V" shaped.

In some embodiments, the catch may have a width that is more than a diameter of the hole in the tab of the beverage can. In these embodiments, the catch may include at least one barb that is larger than a diameter of the hole in the tab of the beverage can. In these embodiments, the material may be sufficiently pliable that the barb can be deformed to fit through hole, and the material is sufficiently rigid that once the barb has been threaded through the hole in the tab, the beverage can is retained on the stringer. Further, the elongated neck may have a width or diameter that is less than the diameter of the hole in the tab of the beverage can.

In some embodiments, the stopper may form a closed loop that is configured to facilitate holding the stringer.

In some embodiments, the elongated neck may be made from cardboard and the stopper may be made from a ferromagnetic material that is attached with an adhesive to a portion of the elongated neck.

In some embodiments, the stringer may be an integral part of a packaging unit in which the beverage cans are sold. In these embodiments, the packaging unit in which the beverage cans are sold may be a paperboard box.

In another embodiment, a stringer for retaining empty beverage cans is disclosed that includes a catch at a first end of the stringer configured to be threaded through a hole in a tab of a beverage can, wherein the catch has a width that is more than a diameter of the hole in the tab of the beverage can, and the catch is constructed from a material that is sufficiently deformable to be threaded through the hole in the tab of the beverage can and sufficiently rigid to retain the beverage can, once threaded through the hole in the tab, on the stringer; an elongated neck connected one end to the catch, the elongated neck being configured to hold a plurality of beverage cans; and a stopper connected to an opposite end of the elongated neck, the stopper being configured to prevent the beverage cans from falling off of a second end of the stringer.

In yet another embodiment, a stringer for retaining empty beverage cans is disclosed that includes a catch at a first end of the stringer configured to be threaded through a hole in a tab of a beverage can, wherein the catch has a width that is more than a diameter of the hole in the tab of the beverage can, and the catch is constructed from a material that is sufficiently deformable to be threaded through the hole in the tab of the beverage can and sufficiently rigid to retain the beverage can, once threaded through the hole in the tab, on the stringer; an elongated neck connected one end to the catch, the elongated neck having a width or diameter that is less than the diameter of the hole in the tab of the beverage can and the elongated neck being configured to hold a plurality of beverage cans; and a stopper connected to an opposite end of the elongated neck, the stopper having a width that is more than the diameter of the hole in the tab of the beverage can and the stopper being configured to prevent the beverage cans from falling off of a second end of the stringer. The catch, the elongated neck and the stopper may all be manufactured from a unitary piece of material.

It is to be understood that both the foregoing summary and the following detailed description are explanatory and are not restrictive of the invention as claimed.

BRIEF DESCRIPTION OF THE DRAWINGS

Embodiments will be described and explained with additional specificity and detail through the use of the accompanying drawings in which.

DETAILED DESCRIPTION

Beverage manufacturers often sell their products in aluminum cans. Boxes and other packaging materials make these canned beverages simple to buy and transport. However, there is no simple way to collect and transport empty beverage cans. The most basic way to collect and transport empty beverage cans is by manually carrying as many as possible. This, however, is inefficient and time consuming. Another option is to use the packaging unit in which the full beverages were sold to collect and carry empty cans. This, however, may result in contaminating cans that are still full and within the packaging and may require full beverages to be removed from the packaging, which defeats the purpose of having packaging unit that allows people to consume as few or as many beverages as they choose. Placing empty beverage cans in trash bags is another options, however, trash bags are inconvenient, cost much more, use more material, and visually obscure the contents of the bag, which could result in the beverage cans being discarded and not recycled.

Figure 1:
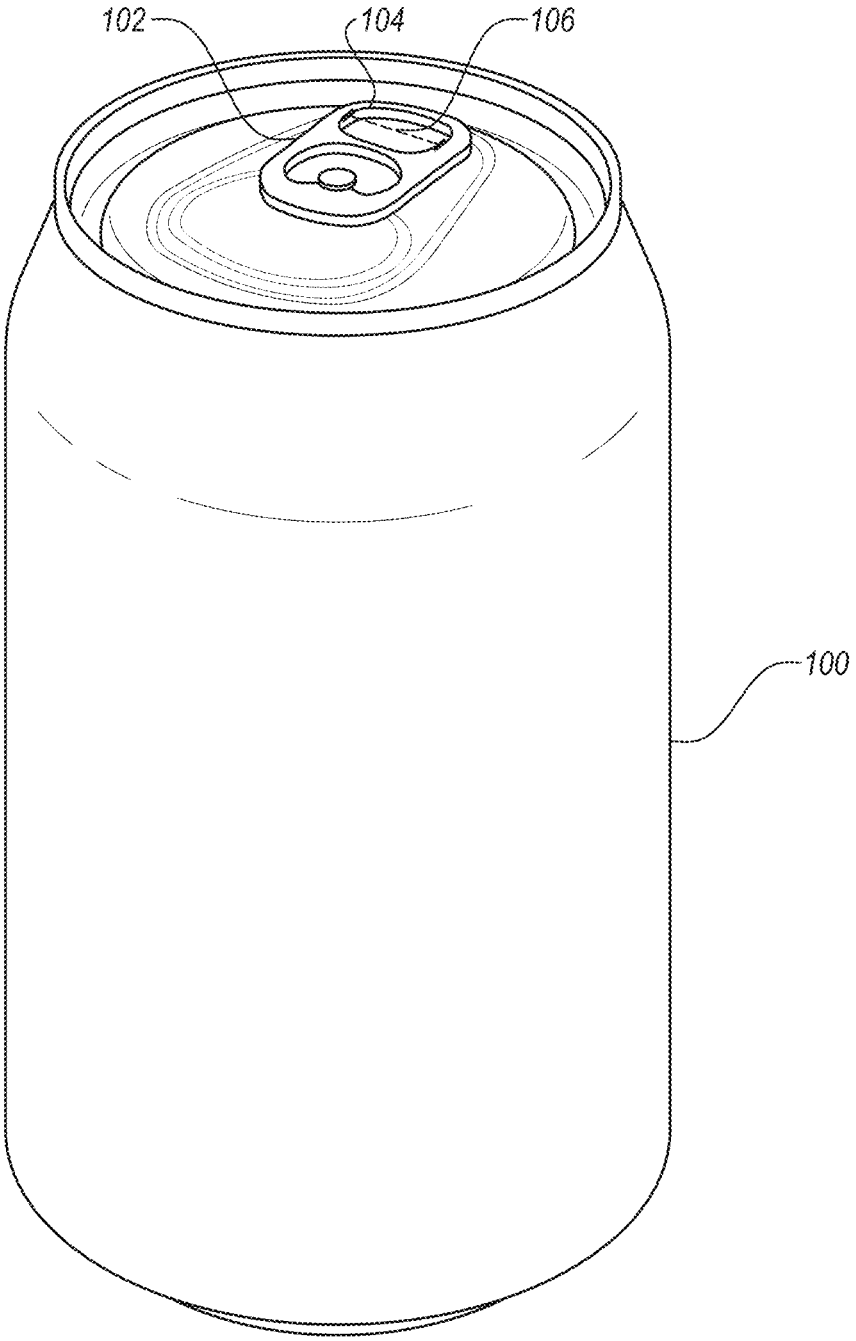
FIG. 1 (Prior Art)
FIG. 1 illustrates beverage can with a tab for opening.

Thus, it would be desirable to have a device that could hold numerous empty beverage cans to keep them organized, keep them in a generally upright position to prevent any residual liquids from spilling out and making a mess, and to make it easier to transport the cans to another location. In one embodiment, a tab on a beverage can may be used to retain empty beverage cans. For example, FIG. 1 illustrates an exemplary can 100 that may be similar to cans that are currently available and used to hold a variety of beverages. The can 100 includes a tab 102. The tab 102 may be used to facilitate opening the can 100. The tab 102 may include a hole 104. This hole 104 may have a number of different shapes. For example, the hole may be circular or oval. Regardless of the shape, these holes may have a diameter that, at their widest point, is approximately 1.2 cm long. Some tab holes may be slightly larger than 1.2 cm or slightly less than 1.2 cm.

Some embodiments disclosed herein may include a stringer for retaining empty beverage cans. The stringer may include a catch at a first end of the stringer. The catch may be configured to be threaded through a hole in a tab of a beverage can. The stringer may also include a stopper that is configured to prevent the beverage cans from falling off of a second end of the stringer. An elongated neck may be positioned between the catch and the stopper that is configured to hold a plurality of beverage cans. The catch, the stopper, and the elongated neck may all be manufactured from a unitary piece of material.

Figure 2:
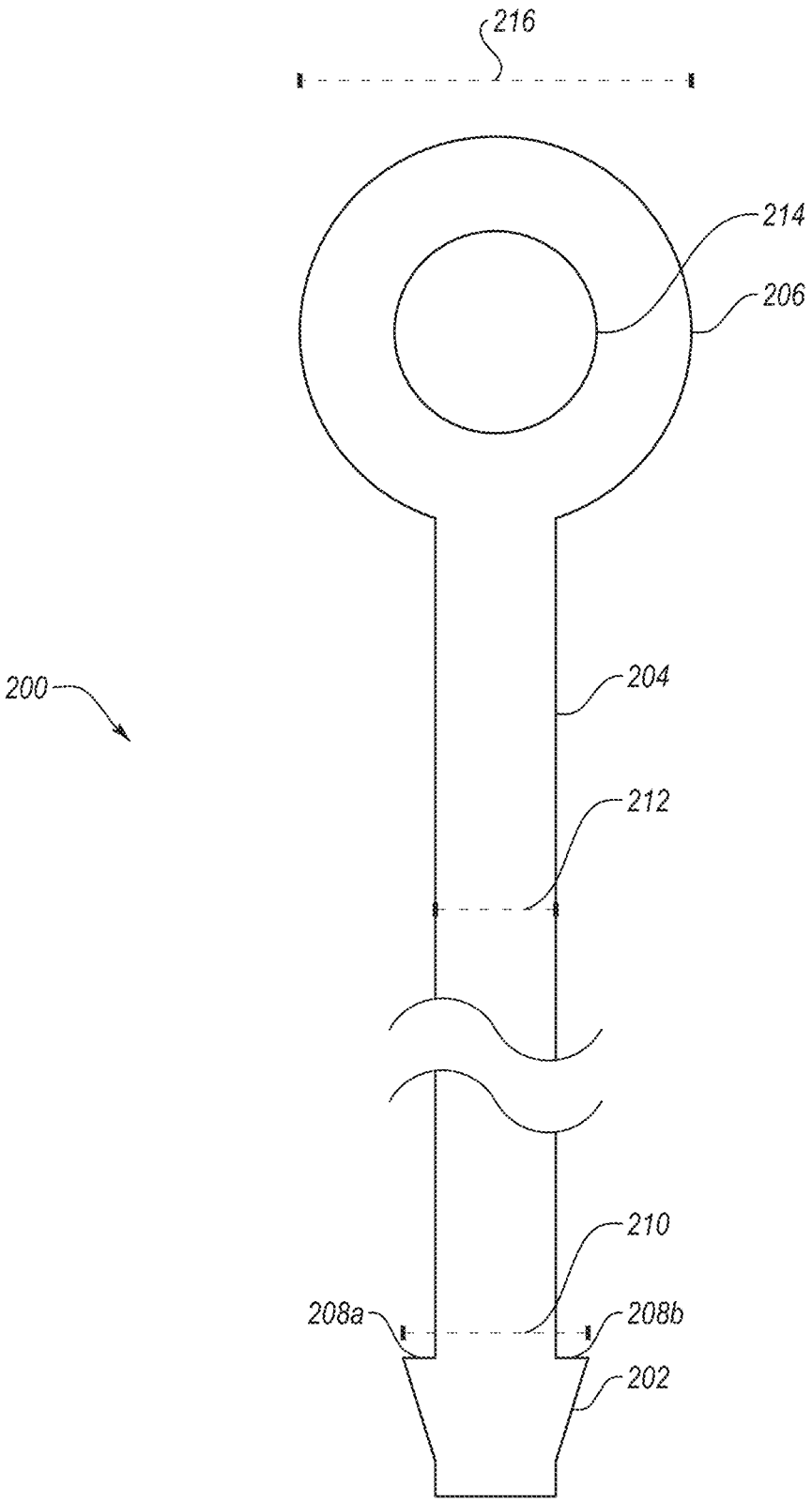
FIG. 2 illustrates a stringer for retaining empty beverage cans.

FIG. 2 illustrates a stringer 200 for retaining empty beverage cans. The stringer 200 includes a catch 202, an elongated neck 204, and a stopper 206. The catch 202 may be positioned at a first end of the stringer 200. A portion of the catch may have a width that is more than a diameter of the hole in the tab of the beverage can. For example, in some embodiments, the catch 202 may include barbs 208*a* and 208*b*. These barbs may have a width 210 that is larger than a diameter of the hole in the tab of the beverage can. For example, the width 210 may be approximately 1.5 cm, or more.

The entire catch 202, or just the barb portions 208*a* and 208*b* may be constructed from a semi-pliable material. For example, the catch 202 or the barbs 208*a* and 208*b* may be constructed from cardboard, plastic, foam, rubber, metal, etc. It may be desirable that the stringer 200 or a portion of the stringer 200 be constructed from aluminum so that the stringer 200 may remain attached to empty cans during the recycling process. It may also be desirable that the stringer 200 be constructed from a ferromagnetic metal so that it can be easily extracted by a magnet in the recycling process.

Regardless of specific material, the catch 202 may be sufficiently pliable that it may be partially deformed to fit through the hole in the tab of the beverage can. However, the catch 202, or just the barb portions 208*a* and 208*b* may be sufficiently rigid that once the barb has been threaded through the hole in the tab, the beverage can is retained on the stringer.

The elongated neck 204 may be positioned between the catch 202 and the stopper 206, and may have any desired length. In some embodiments, the elongated neck 204 may be sufficiently long that a plurality of empty beverage cans may be held on the stringer 200. The elongated neck 204 may have any type of cross-sectional shape. For example, the elongated neck may have a cross-sectional shape that is flat, rectangular, round, oval, triangular, or "V" shaped.

The elongated neck 204 may have a width or diameter 212. The width or diameter 212 may be less than the diameter of the hole in the tab of the beverage can so that once the catch 202 has been threaded through the hole in the tab of a beverage can, the can is able to move freely up and down the elongated neck 204. In some embodiments, the width or diameter 212 of the elongated neck 204 may be less than approximately 1.2 cm.

The stopper 206 may be connected to an end of the elongated neck 204 opposite the catch and may be configured to prevent the beverage cans from falling off of a second end of the stringer. For example, the stopper may have a width that this more than the hole in the tab of the beverage can. In some embodiments, the stopper may form a closed loop 214 or another shape that is configured to facilitate holding the stringer.

In some embodiments, the catch 202, the elongated neck 204, and the stopper 206 may all be all manufactured from a unitary piece of material. In other embodiments, these components may be separately manufactured from different materials.

For example, in one embodiment, the stopper 206 may be made from a ferromagnetic object. This ferromagnetic object stopper may be attached to a portion of the elongated neck 204 that is opposite the catch. One skilled in the art will recognize many different ways of attaching the ferromagnetic object stopper to the elongated neck 204. In one embodiment, an adhesive such as glue may be used. The ferromagnetic object stopper may have any shape and size, provided that it has a width that is more than the hole in the tab of a beverage can. For example, the ferromagnetic object stopper may form a circular or oval ring, a square, a triangle, etc.

In another embodiment, the ferromagnetic object may be adhered to a substrate that is connected to the elongated neck 204. This substrate may have the same shape as the ferromagnetic object stopper. In one embodiment, the catch 202, the elongated neck 204, and the substrate may all be all manufactured from a unitary piece of material, for example, cardboard. The ferromagnetic object stopper may then be glued to the substrate and/or a portion of the elongated neck 204.

Modifications, additions, or omissions may be made to the stringer 200 without departing from the scope of the present disclosure. For example, in some embodiments, the stringer 200 may include additional components similar to the components illustrated in FIG. 2 that each may be configured similarly to the components illustrated in FIG. 2.

Figure 3:
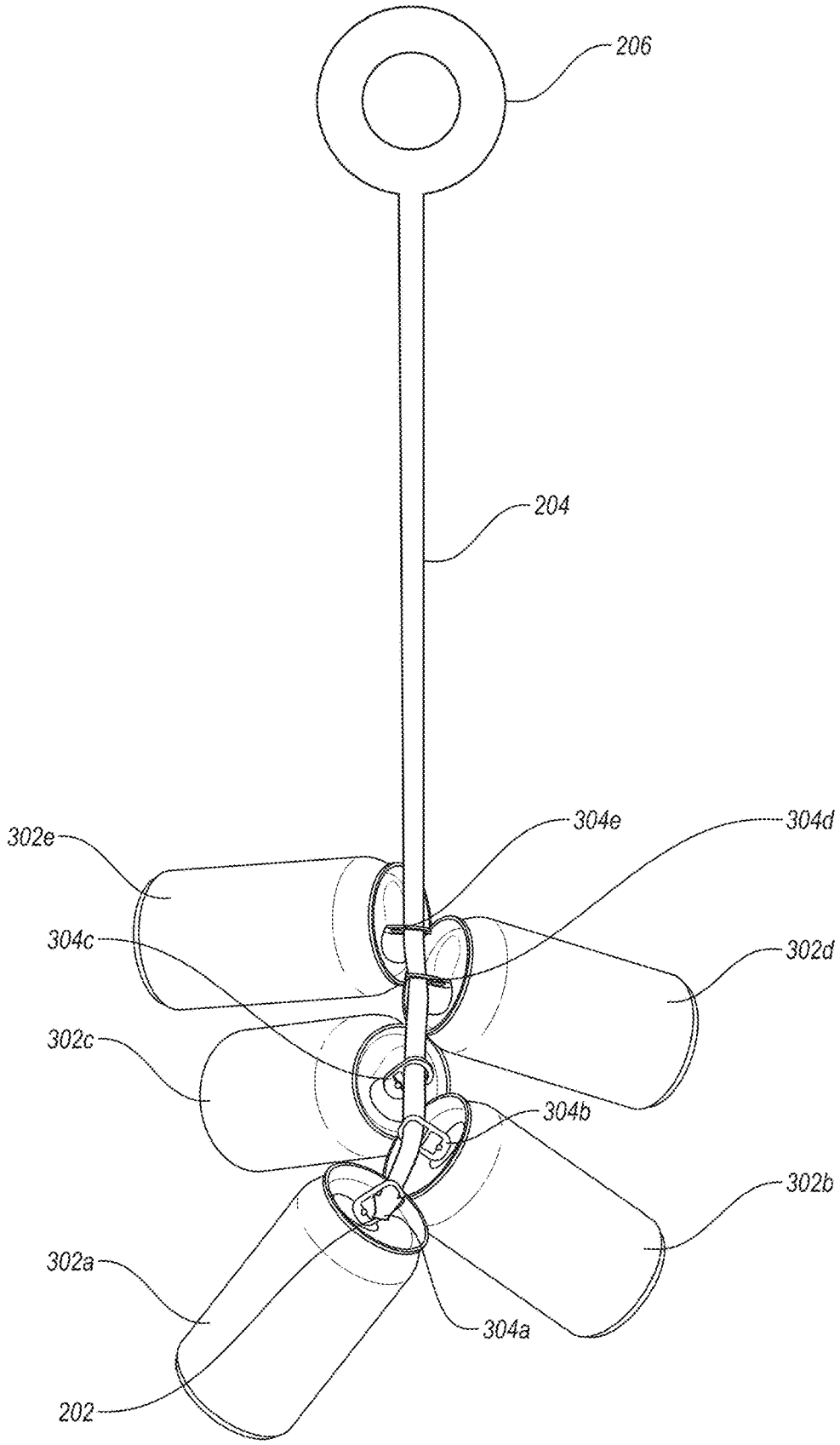
FIG. 3 illustrates the stringer of FIG. 2 with empty beverage cans attached.

FIG. 3 illustrates the stringer 200 of FIG. 2 with empty beverage cans 302*a*, 302*b*, 302*c*, 302*d*, and 302*e* attached. Each of the empty beverage cans 302*a*, 302*b*, 302*c*, 302*d*, and 302*e* include tabs 304*a*, 304*b*, 304*c*, 304*d*, and 304*e*. Each of tabs 304*a*, 304*b*, 304*c*, 304*d*, and 304*e* includes a hole, through which the catch 202 has been threaded. The empty beverage cans 302*a*, 302*b*, 302*c*, 302*d*, and 302*e* can slide up and down the elongated neck 204. The barbs on catch 202 prevents the empty can 302*a* from falling off of the stringer 200.

Figure 4:
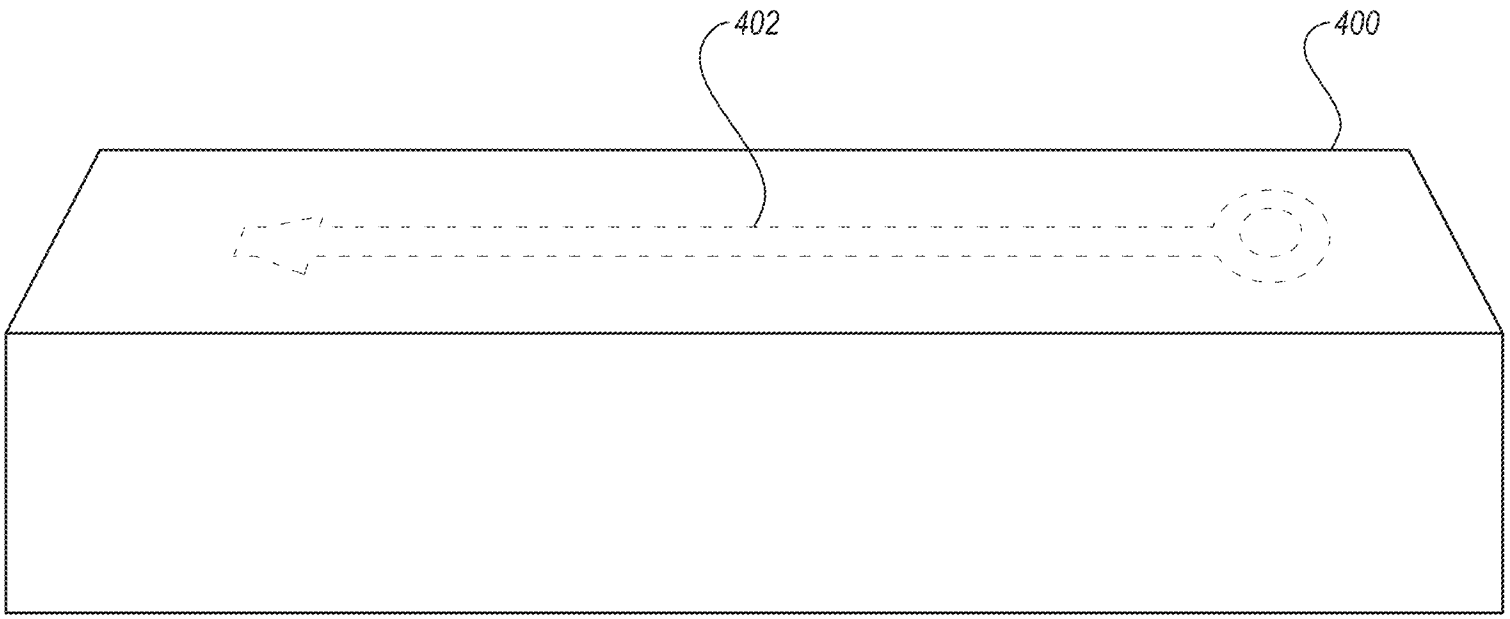
FIG. 4 illustrates a packaging unit with an integrated stringer.

FIG. 4 illustrates a packaging unit 400 that is configured to retain beverage cans. The packaging unit 400 may be constructed from a cardboard material, such as paperboard. The packaging unit 400 may include an integrated stringer 402. The integrated stringer 402 may be removable from the packaging unit 400. For example, the integrated stringer 402 may have perforated edges or another mechanism making removal from the packaging unit 400 simple. In one embodiment, the packaging unit 400, including the stringer 402, is constructed from a single unitary piece of material. In other embodiments, the stringer 402 portion of the packaging unit is constructed from a different material than the rest of the packaging unit 400.

In one embodiment, the integrated stringer may include a catch, an elongated neck, and a stopper. The stopper may be made in whole or in part of a ferromagnetic material, which is attached to the elongated neck portion of the stringer 402. For example, an adhesive such as glue may be used to attach the ferromagnetic stopper to the elongated neck portion of the stringer 402. In this embodiment, the ferromagnetic stopper may also be attached to the packaging unit 400. However, the attachment between the ferromagnetic stopper and the elongated neck portion of the stringer 402 may be stronger than the attachment between the ferromagnetic stopper and the packaging unit 400. Thus, when the ferromagnetic stopper is pulled away from the packaging unit 400, the attachment between the ferromagnetic stopper and the packaging unit 400 will break while the attachment between the ferromagnetic stopper and the and the elongated neck portion of the stringer 402 may remain secure.

In accordance with common practice, the various features illustrated in the drawings may not be drawn to scale. The illustrations presented in the present disclosure are not meant to be actual views of any particular apparatus (e.g., device, system, etc.) or method, but are merely example representations that are employed to describe various embodiments of the disclosure. Accordingly, the dimensions of the various features may be arbitrarily expanded or reduced for clarity. In addition, some of the drawings may be simplified for clarity. Thus, the drawings may not depict all of the components of a given apparatus (e.g., device) or all operations of a particular method.

Terms used herein and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, it is understood that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the summary, detailed description, claims, or drawings, should be understood to contemplate the possibilities of including one of the terms, either of the terms, or both terms. For example, the phrase "A or B" should be understood to include the possibilities of "A" or "B" or "A and B."

Additionally, the use of the terms "first," "second," "third," etc., are not necessarily used herein to connote a specific order or number of elements. Generally, the terms "first," "second," "third," etc., are used to distinguish between different elements as generic identifiers. Absent a showing that the terms "first," "second," "third," etc., connote a specific order, these terms should not be understood to connote a specific order. Furthermore, absent a showing that the terms "first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

The foregoing description, for purpose of explanation, has been described with reference to specific embodiments. However, the illustrative discussions above are not intended to be exhaustive or to limit the invention as claimed to the precise forms disclosed. Many modifications and variations are possible in view of the above teachings. The embodiments were chosen and described to explain practical applications, to thereby enable others skilled in the art to utilize the invention as claimed and various embodiments with various modifications as may be suited to the particular use contemplated.

The invention claimed is:

1. A stringer for retaining a beverage can, the stringer system comprising:

a beverage can comprising a tab for opening the beverage can; and a stringer comprising:

a catch at a first end of the stringer, wherein the catch has a first width and is configured to pass through and retain the tab of the beverage can by resisting passage of the catch back through the tab once the catch is inserted into the tab;

a stopper at a second end of the stringer, wherein the stopper has a second width and is configured to resist passage through the tab of the beverage can to prevent the beverage can from falling off of the second end of the stringer; and an elongated neck forming a smooth portion of the stringer between the catch and the stopper, wherein the elongated neck has a third width and is configured to allow the tab of the beverage can to slide along the smooth portion of the elongated neck and configured to allow the tab of the beverage can to slide against the catch and configured to hold the tab of each of a plurality of beverage cans in an approximately linear alignment along the elongated neck, wherein the first width of the catch is less than the second width of the stopper, and the third width of the elongated neck is less than the first width of the catch.

2. The system of claim 1, wherein the catch, the stopper, and the elongated neck are all manufactured from a unitary piece of material.

3. The system of claim 2, wherein the material is cardboard, plastic, or metal.

4. The system of claim 1, wherein the catch includes at least one barb.

5. The system of claim 4, wherein the barb is manufactured from a material that is sufficiently pliant that the barb can be deformed to fit through the tab.

6. The system of claim 1, wherein the stopper forms a closed loop that is configured to facilitate holding the stringer.

7. The system of claim 1, wherein the elongated neck is made from cardboard and the stopper is made from a ferromagnetic material that is attached with an adhesive to a portion of the elongated neck.

8. The system of claim 1, wherein the stringer is an integral part of a packaging unit in which the beverage can is sold.

9. A system comprising:

a beverage can comprising a tab for opening the beverage can, the tab including a hole; and a stringer comprising:

a catch at a first end of the stringer configured to be threaded through the hole in the tab of the beverage can, wherein the catch has a width that is more than a diameter of the hole in the tab of the beverage can, and the catch is constructed from a material that is sufficiently deformable to be threaded through the hole in the tab of the beverage can and sufficiently rigid to retain the beverage can, once threaded through the hole in the tab, on the stringer;

an elongated neck connected one end to the catch, wherein the width of the elongated neck is less than the diameter of the hole in the tab of the beverage can and the elongated neck is configured to hold a plurality of beverage cans; and a stopper connected to an opposite end of the elongated neck, wherein the width of the stopper is greater than the width of the catch and the stopper is configured to prevent the beverage cans from falling off of a second end of the stringer.

10. The system of claim 9, wherein the catch, the elongated neck and the stopper are all manufactured from a unitary piece of material.

11. The system of claim 10, wherein the material is cardboard or plastic.

12. The system of claim 10, wherein the material is aluminum or a ferromagnetic metal.

13. The system of claim 9, wherein the catch includes at least one barb.

14. The system of claim 9, wherein the stopper forms a closed loop that is configured to facilitate holding the stringer.

15. The system of claim 9 further comprising a packaging unit in which the beverage can is sold, wherein the stringer is an integral part of the packaging unit.

16. The system of claim 15, wherein the packaging unit in which the beverage cans are sold is a paperboard box.

17. A system comprising:

a beverage can; and a stringer, the stringer comprising:

a catch formed at a first end of the stringer configured to be threaded through a hole in a tab of the beverage can, wherein the catch has a first width larger than a diameter of the hole in the tab of the beverage can and is constructed from a material that is sufficiently deformable to be threaded through the hole in the tab of the beverage can and is configured to retain the beverage can at the tab by resisting passage of the catch back out of the hole in the tab;

an elongated neck coupled, at one end of the elongated neck, to the catch, wherein the elongated neck has a second width that is less than the first width of the catch and the elongated neck is configured to pass freely through the hole in the tab and hold a plurality of beverage cans with the tab of each of the plurality of beverage cans in an approximately linear alignment along the elongated neck; and a stopper connected to an opposite end of the elongated neck from the catch, wherein the stopper has a third width that is more than the first width of the catch and the stopper is configured to resist passage of the stopper through the hole in the tab of the beverage can to prevent the beverage can from falling off of a second end of the stringer, wherein the catch, the elongated neck and the stopper are all manufactured from a unitary piece of material.

18. The system of claim 17, wherein the material is cardboard, plastic, or metal.

19. The system of claim 1, wherein the first width is at least 1.5 cm.

20. The system of claim 17, wherein the first width is at least 1.5 cm.

* * * * *